US008136813B2

(12) United States Patent
Hantel et al.

(10) Patent No.: US 8,136,813 B2
(45) Date of Patent: Mar. 20, 2012

(54) APPARATUS FOR PRESSING FLAT MATERIALS ONTO A TRANSPORT MODULE

(75) Inventors: Ulrich Hantel, Berlin (DE); Wolfgang Muhl, Hohen Neuendorf (DE); Dieter Wölm, Ludwigsfelde OT Gross-Schulzendorf (DE)

(73) Assignee: Francotype-Postalia GmbH, Birkenwerder (DE)

( * ) Notice: Subject to any disclaimer, the term of this patent is extended or adjusted under 35 U.S.C. 154(b) by 730 days.

(21) Appl. No.: 12/252,697

(22) Filed: Oct. 16, 2008

(65) Prior Publication Data

US 2009/0153636 A1 Jun. 18, 2009

(30) Foreign Application Priority Data

Dec. 17, 2007 (DE) ..... 10 2007 060 789

(51) Int. Cl.
*B65H 5/02* (2006.01)

(52) U.S. Cl. ..... 271/275; 198/626.1

(58) Field of Classification Search ..... 271/3.21, 271/6, 275, 198; 198/626.1, 626.3, 626.5, 198/626.6, 688.1
See application file for complete search history.

(56) References Cited

U.S. PATENT DOCUMENTS

| | | | | |
|---|---|---|---|---|
| 3,730,514 | A | 5/1973 | Burkhardt | |
| 3,944,211 | A | 3/1976 | Rasmussen et al. | |
| 4,079,576 | A | 3/1978 | Morrison et al. | |
| 4,746,234 | A | 5/1988 | Harry | |
| 5,192,066 | A | 3/1993 | Steinhilber | |
| 5,401,540 | A * | 3/1995 | Miles et al. | 427/256 |
| 5,467,709 | A * | 11/1995 | Salomon | 101/93 |
| 5,813,326 | A | 9/1998 | Salomon | |
| 5,880,747 | A | 3/1999 | Bartenwerfer et al. | |
| 5,949,444 | A | 9/1999 | Geserich et al. | |
| 6,343,786 | B1 | 2/2002 | Gregoire et al. | |
| 6,431,778 | B1 | 8/2002 | Coudray et al. | |
| 6,467,901 | B2 | 10/2002 | Von Inten | |
| 6,469,262 | B1 | 10/2002 | Czernysz et al. | |
| 6,550,994 | B2 | 4/2003 | Manduley | |
| 6,557,850 | B1 * | 5/2003 | Kallin et al. | 271/274 |
| 6,585,433 | B2 | 7/2003 | Davies et al. | |
| 6,776,089 | B2 | 8/2004 | Kanda | |

(Continued)

FOREIGN PATENT DOCUMENTS

CH 597652 A5 4/1978

(Continued)

OTHER PUBLICATIONS

European Search Report dated Sep. 1, 2010.

*Primary Examiner* — Michael McCullough
(74) *Attorney, Agent, or Firm* — Laurence A. Greenberg; Werner H. Stemer; Ralph E. Locher

(57) ABSTRACT

An apparatus for pressing flat materials onto a transport module with a transport belt includes a holding carrier for pressing elements being disposed under a feed table. At least one of the pressing elements is mounted on the holding carrier with a multiplicity of individual resilient or sprung constituent parts, or a multiplicity of pressing elements are disposed on the holding carrier below the transport belt in a transport direction. The pressing elements can protrude through an opening in the feed table, in order to provide suitable pressure from below on the transport belt of the transport module.

11 Claims, 3 Drawing Sheets

U.S. PATENT DOCUMENTS

| | | | |
|---|---|---|---|
| 2005/0171921 | A1 | 8/2005 | Nicolas et al. |

FOREIGN PATENT DOCUMENTS

| | | | |
|---|---|---|---|
| DD | 233101 | B5 | 10/1995 |
| DE | 1561189 | C | 5/1971 |
| DE | 2450740 | A1 | 4/1975 |
| DE | 2617189 | A1 | 11/1976 |
| DE | 2844150 | C2 | 5/1986 |
| DE | 4033237 | A1 | 4/1992 |
| DE | 19605014 | C1 | 3/1997 |
| DE | 19605015 | C1 | 3/1997 |
| DE | 102007007993 | A1 | 10/2007 |
| EP | 0484663 | A2 | 5/1992 |
| EP | 11079975 | B1 | 3/2001 |
| EP | 1170141 | B1 | 1/2002 |
| EP | 1362644 | A1 | 11/2003 |
| GB | 2005622 | A | 4/1979 |
| JP | 2007277008 | A | 10/2007 |
| WO | 9944174 | A1 | 9/1999 |

* cited by examiner

APPARATUS FOR PRESSING FLAT MATERIALS ONTO A TRANSPORT MODULE

CROSS-REFERENCE TO RELATED APPLICATION

This application claims the priority, under 35 U.S.C. §119, of German Patent Application DE 10 2007 060 789.1, filed Dec. 17, 2007; the prior application is herewith incorporated by reference in its entirety.

BACKGROUND OF THE INVENTION

Field of the Invention

The invention relates to an apparatus for pressing flat materials onto a transport module of a printing apparatus which is controlled by a microprocessor and has, in a printing position, a printing module which does not move during printing. The flat materials are fed in to the printing apparatus on a feed table and are pressed onto a transport belt in a supporting region counter to the force of gravity. The invention is used in printing apparatuses which are controlled by a microprocessor and is suitable for franking machines and other mail processing units.

An apparatus which employs a transport principle and has a belt that lies at the top and a sprung back pressure apparatus that lies underneath, between which an item of mail is clamped, is known from East German Patent Application DD 233 101 B5, corresponding to U.S. Pat. No. 4,746,234. However, a thermal transfer ink ribbon which is used is unsuitable as a transport belt. The thermal transfer ink ribbon is disposed above a feed table, over which the items of mail are transported in a lying manner downstream in the direction of the mail flow. The feed table has openings, through which a driven back pressure roller engages on the item of mail.

U.S. Pat. No. 6,550,994 has disclosed a franking machine having a transport apparatus for items of mail, by way of which transport apparatus the letters are transported through the franking machine through the use of a transport belt which lies at the top and a plurality of sprung levers which are disposed underneath. Similar subject matter is also apparent from U.S. Pat. No. 5,813,326, U.S. Pat. No. 6,776,089 and U.S. Pat. No. 6,585,433. The transport belt is mounted in the manner of a loop on rollers and does not allow the printing module or a part thereof to protrude into the region between the rollers. The width of the transport belt is relatively small and corresponds to approximately 1 inch. The extent of the housing transversely with respect to the transport direction of the items of mail is relatively great in comparison. An additional factor is that a second printing position is provided for printing franking strips which are rolled up on reels and which are unrolled for printing. That second printing path causes higher production costs.

U.S. Pat. No. 5,467,709 has already disclosed a printing apparatus for an inkjet franking machine, in which a franking imprint is printed onto an item of mail through the use of an inkjet print head during approximately horizontal letter transport. The inkjet print head is disposed in a stationary manner behind a guide plate in a recess for printing. A circulating transport belt, which is likewise disposed on the side of the guide plate, serves as a transport apparatus. A supporting and pressing apparatus having a plurality of rollers is disposed on the other side opposite the guide plate, with the result that an item of mail which is fed in is clamped between the rollers of the supporting and pressing apparatus and the circulating transport belt. However, the apparatus cannot avoid oblique running of the printing media. An insufficiently tensioned transport belt or a not exactly parallel alignment of the axles of those rollers, on which the transport belt circulates, is sufficient to involve the above-mentioned risk. The supporting and pressing apparatus is very complicated as a result of the multiplicity of rollers of that apparatus.

German Patent DE 196 05 015 C1, corresponding to U.S. Pat. No. 5,949,444, has already proposed an embodiment of a printing apparatus of an inkjet franking machine which is the JetMail® apparatus of the applicant of the instant application, Francotyp-Postalia AG & Co. That embodiment carries out a franking imprint during non-horizontal, approximately vertical letter transport through the use of an inkjet print head which is disposed in a stationary manner behind a guide plate in a recess. A circulating transport belt having pressing elements for the items of mail (letters up to 20 mm thickness, DIN (German Standard) B4 format) or for franking strips, which are configured in such a way that they can be adhesively bonded to packages of any desired thickness, serves as a transport apparatus. The printing medium (letter, package, franking strip) is clamped between the pressing elements and the guide plate.

Transport and drive apparatuses of relatively simple construction without a back pressure apparatus (see German Patent DE 196 05 014 C1) or with a back pressure apparatus (see International Publication No. WO 99/44174) in the vicinity of the printing region using at least one inkjet print head, have also already been proposed. In International Publication No. WO 99/44174, the latter is disposed downstream of an intake roller pair in the transport direction of the mail flow, with the upper roller being driven and the lower back pressure roller being sprung. A further roller pair downstream of the inkjet print head in the mail flow direction close to an ejection device likewise exerts a force on the printing medium. The printing region is spaced apart from the force transmission region of one of the roller pairs by more than one radius of the respectively driven roller. Although the printing information can in principle be changed in all regions by digital printing, the print quality becomes lower as a higher transport speed is selected. In particular, during the use of two inkjet print heads, an offset in the printed image (butting or connection error) can occur along a printed length in the transport direction. The offset makes evaluation of the printed image by machine difficult. The action of the force of the further roller pair downstream of the inkjet print head in the direction of the mail flow close to the ejection device leads to different distances being covered and therefore to the butting or connection error in the printed image in the case of two inkjet print heads which are offset with respect to one another. The print quality which is required in the context of current programs of mail deliverers (for example, the Information Based Indicia Program of the USPS) would therefore only be possible to achieve at a low printing speed. The low thickness of the printing media which can be printed by a printing apparatus that is constructed simply in that way is also disadvantageous.

European Patent EP 1 079 975 B1, corresponding to U.S. Pat. No. 6,431,778, has disclosed an apparatus for printing characters on a predefined location of one side of a flat recording medium, and has also disclosed a franking machine which is equipped correspondingly. A transport belt is disposed firstly on the inkjet print head side and secondly forms an unsuspended supporting device for that side of a flat recording medium (object, item of mail, envelope) which is to be printed. A back pressure apparatus supports the flat object from below. In that back pressure apparatus, a belt rolls around at least two other rollers, at least one of which is not suspended.

An apparatus which is known from European Patent EP 1 170 141 B1, corresponding to U.S. Pat. No. 6,467,901, for printing a printing medium in the printing region, uses a driven transport drum and nondriven back pressure rollers in the force transmission region or, as an alternative, a nondriven back pressure conveyor belt. In the printing region, a stationary inkjet print head prints the printing medium which is moved downstream, with the inkjet print head being disposed axially with respect to the transport drum. The printing region is preferably approximately 1 inch and is spaced apart from the force transmission region, with the spacing of the most remote pixel from the edge of the transport drum being smaller than the radius of the circumference of the transport drum. However, the slight approximately linear contact of that surface of the item of mail which is to be printed with the transport drum and an intake wheel for items of mail which is disposed at a spacing are disadvantageous. The intake wheel is driven by the transport drum through a toothed belt. This causes a $\Delta x$ offset of the dots in the printed image. A $\Delta y$ offset of the dots in the printed image results orthogonally with respect thereto, in particular in the case of items of mail having a very large format. Moreover, the construction causes high production costs.

In the market segment of franking machines having small to medium mail item throughputs, a compact transport apparatus for items of mail is required, in which the items of mail are not to be contaminated, however, by free spraying. In the case of horizontal mail item transport, it is assumed that an ink cartridge is disposed above a printing window in the z-direction of a Cartesian coordinate system counter to the direction of gravity. During printing, at least one inkjet print head ejects ink droplets in the direction of gravity, counter to the z-direction, and those ink droplets fly through the printing window. The printing window is disposed at the edge of a transport belt in the y-direction in a housing part, with the transport belt transporting a flat material which is to be printed at the edge past the at least one print head in the transport direction x during printing.

SUMMARY OF THE INVENTION

It is accordingly an object of the invention to provide an apparatus for pressing flat materials onto a transport module of a printing apparatus which is controlled by a microprocessor, which overcomes the hereinafore-mentioned disadvantages of the heretofore-known devices of this general type and in which the printing apparatus ensures high print quality with low production costs and a medium mail item throughput. The reliability of the printing apparatus is to be as high as possible and the printing offset in the x-direction and y-direction is to be so low that the imprint can be read by machine. In this case, firstly postcards and secondly C4 sized letters having a mail item thickness of up to 10 mm are to be processed.

With the foregoing and other objects in view there is provided, in accordance with the invention, in a microprocessor-controlled printing apparatus including a transport module, a printing module not moving during printing in a printing position, a feed table on which flat materials are fed in to the printing apparatus, and a transport belt onto which the flat materials are pressed in a supporting region counter to the force of gravity, an apparatus for pressing the flat materials onto the transport module. The pressing apparatus comprises a holding carrier for pressing elements disposed under the feed table. At least one of the pressing elements is mounted on the holding carrier with a multiplicity of individual resilient or sprung components or constituent parts and protrudes through an opening formed in the feed table, or a multiplicity of the pressing elements are disposed on the holding carrier below the transport belt in a transport direction and protrude through the opening formed in the feed table, to provide suitable pressure from below on the transport belt of the transport module.

The transport module is disposed above the feed table and has a transport belt for items of mail or flat printing materials in a manner which is known per se. Suitable pressing from below onto the transport belt of the transport module is realized by the pressing elements which are disposed below the transport belt in the transport direction. In this case, the pressing elements are mounted on a holding carrier. The pressing surface area of the pressing elements is to be as great as possible. It has been ascertained empirically that scarcely any joining error occurs in the printed image in the case of a multiplicity of pressing elements which act over their full surface area. A joining error is produced during printing of a continuous perpendicular line by way of two half-inch inkjet print heads which are disposed offset with respect to one another, as a result of a transport difference of the flat material or item of mail with respect to the two half-inch inkjet print heads. The holding carrier can be mounted in a resilient or sprung manner, in order to compensate for letter thicknesses of up to 10 mm. Pressing elements which run in and out have a special geometry. The pressing elements can be disposed on the holding carrier in such a way that they are inclined or at right angles with respect to the transport belt. As an alternative, the individual pressing elements can also be replaced by a complete pressing body.

Other features which are considered as characteristic for the invention are set forth in the appended claims.

Although the invention is illustrated and described herein as embodied in an apparatus for pressing flat materials onto a transport module, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
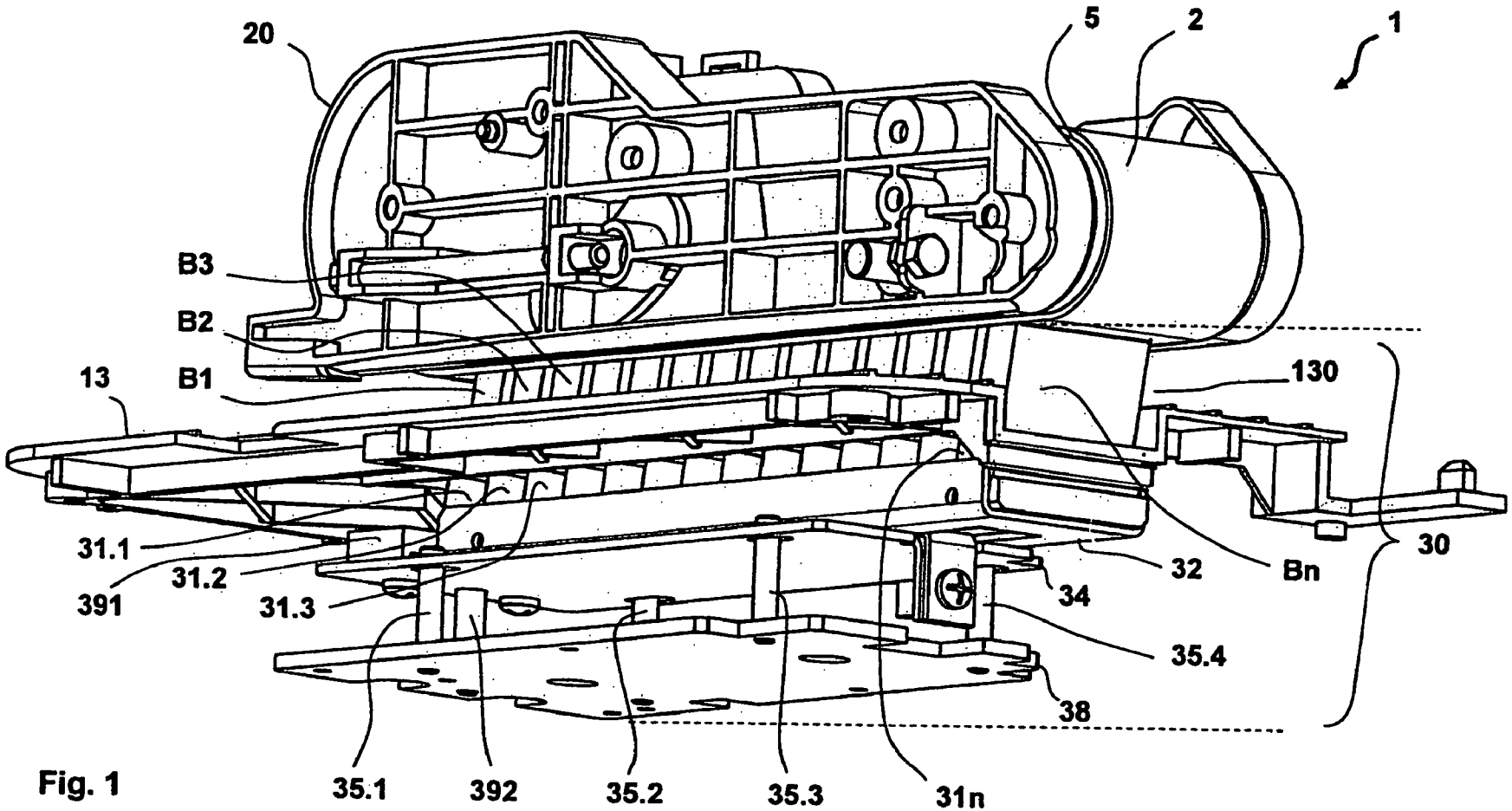
FIG. 1 is a perspective view of a transport apparatus having a transport module without a printing module, having a feed table and having a pressing apparatus.

Referring now to the figures of the drawings in detail and first, particularly, to FIG. 1 thereof, there is seen a perspective view of a transport apparatus 1 from the front at the bottom right. The transport apparatus 1 is provided for flat materials or items of mail and is equipped with a transport module without a printing module, with a feed table 13 and with a pressing apparatus 30. The transport module includes a roller carrier 20 having a driven roller 5 and further (concealed) deflection rollers, and having a transport belt 2 which is configured as a flat belt.

The transport module is disposed above the pressing apparatus 30, which protrudes partially through an opening 130 in the feed table 13. The pressing apparatus 30 includes protruding brush elements B1, B2, B3, . . . Bn and a holding carrier 32 having a multiplicity of holders 31.1, 31.2, 31.3 to 31.*n* for the brush elements. The pressing apparatus 30 also includes a slide-in unit 34 to 38 without spring elements which generates a back pressure from below on the brush elements. The spring elements can be omitted, in particular, in the case of very flat materials or thin items of mail which are to be transported, if the brush elements B1, B2, B3, . . . Bn are sufficiently resilient or sprung and flexible per se. The brush elements are provided in order to adapt themselves to the underside of a non-illustrated flat material or item of mail without impeding the transport.

Figure 2:
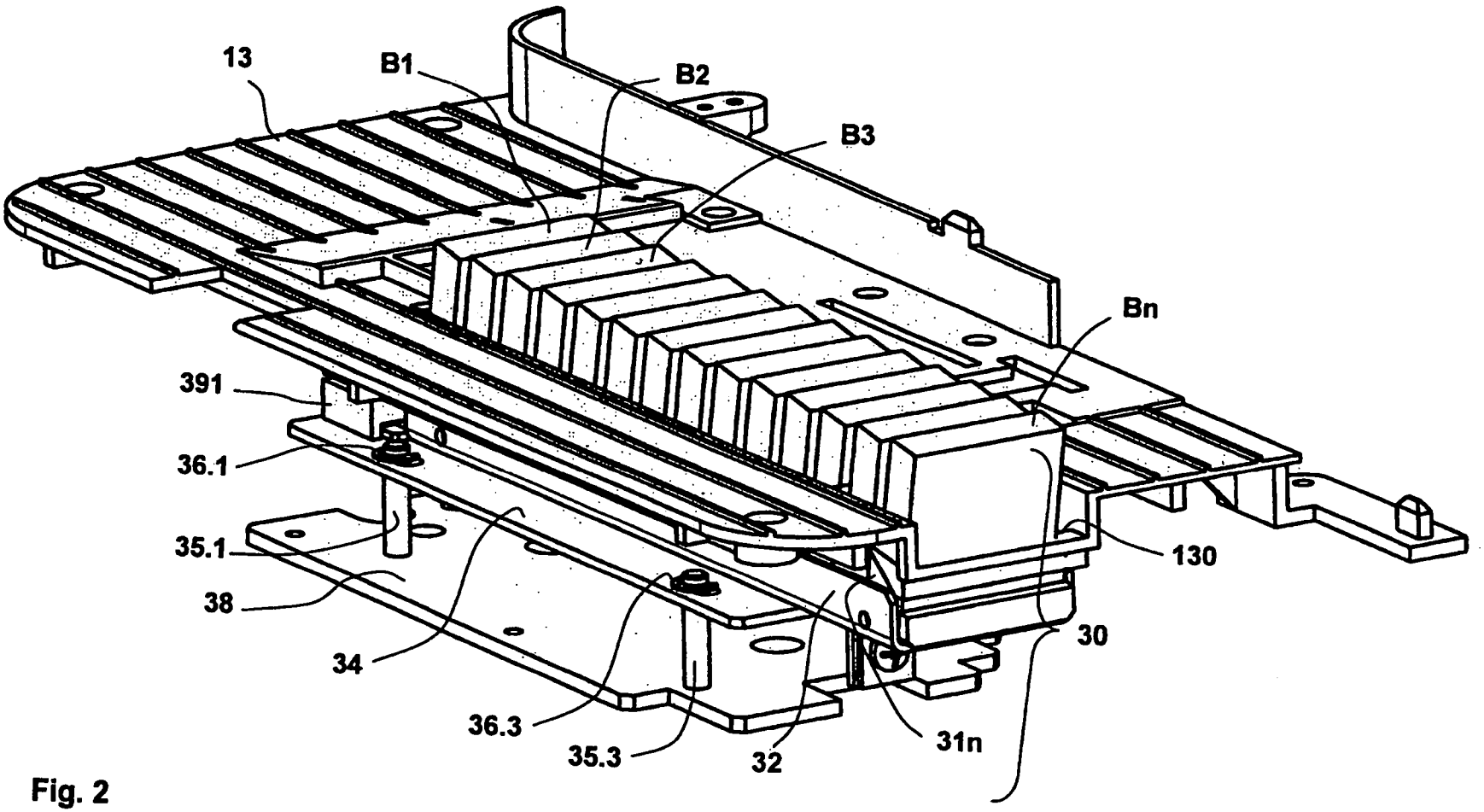
FIG. 2 is a perspective view of the pressing apparatus which is disposed on the feed table, having a holding carrier and having an unsprung slide-in unit.

FIG. 2 shows a perspective view of the pressing apparatus from the front at the top right. The pressing apparatus is disposed on the feed table 13. The pressing apparatus 30 includes the holding carrier 32 and the unsprung slide-in unit 34 to 38. The holding carrier 32 is equipped with the multiplicity of brush elements B1, B2, B3 to Bn and with the corresponding holders for the latter. The brush elements protrude through the opening 130 in the feed table 13. A first brush element B1 is disposed on an inlet side of a mail flow and a last brush element Bn is disposed on an outlet side of the mail flow. Each brush element is fastened in a corresponding holder. Thus, for example, the brush element Bn is fastened in the holder 31.*n*. The holder and therefore each brush element can be inclined in the transport direction, as has been shown in FIG. 2, but they can also not be inclined.

The slide-in unit 34 to 38 is shown without spring elements, is disposed below the holding carrier 32 and is configured for supporting the holding carrier or for pressing and clamping the latter and a non-illustrated flat material or item of mail from below against the flat belt of the transport module in a manner which is not shown.

Figure 3:
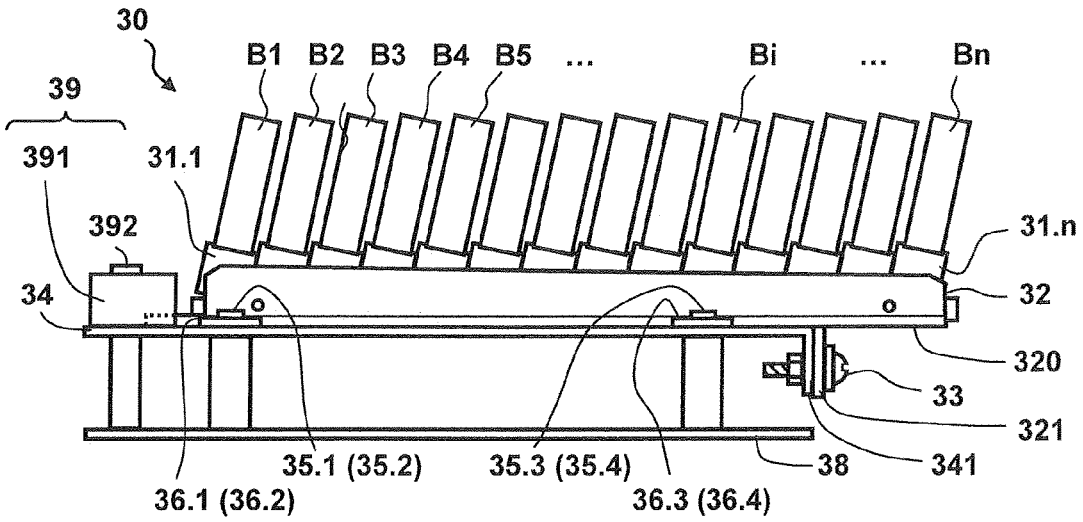
FIG. 3 is a front-elevational view of the pressing apparatus having an unsprung slide-in unit.

FIG. 3 shows a front view of the holding carrier 30 having the multiplicity of brush elements and an unsprung slide-in unit. The holding carrier 30 has the multiplicity of brush elements B1, B2, B3, . . . , Bi, . . . , Bn and holders 31.1, 31.2, 31.3 . . . , 31.*i*, . . . 31.*n* for the brush elements. The holders are fastened in the holding carrier 32 which has a base plate 320, from which a first bracket 321 has been machined and is angled away at right angles. The latter and two horns on the mail flow inlet side of the base plate 320 (shown in dashed lines) serve to fasten the unsprung slide-in unit 34 to 38.

A second bracket 341, which is connected force-lockingly and form-lockingly to the first bracket 321 of the holding carrier 32, is bent away to the bottom from a base plate 34 of the unsprung slide-in unit 34 to 38. A screw connection is produced, for example, through the use of a metal screw 33 which, starting from the mail flow outlet side, is plugged through a hole in the first bracket 321, is screwed into a hole with a thread in the second bracket 341 and is optionally secured by a lock nut. A force-locking connection is one which connects two elements together by force external to the elements, as opposed to a form-locking connection which is provided by the shapes of the elements themselves.

An adjusting and fastening piece 391, having two holes which have been machined into the above-mentioned piece and point in the opposite direction to the transport direction, is provided on the mail flow inlet side of the base plate 34. The holding carrier 32 is plugged into the holes with its two horns (shown in dashed lines). The adjusting and fastening piece 391 is fastened on the base plate 34 by a non-illustrated screw connection and has an opening for an adjusting and fastening bolt 392. The adjusting and fastening bolt 392 is fastened on a floor plate 38, for example likewise by screwing. The base plate 34 is fastened on the floor plate 38 through spacer bolts 35.1, 35.2, 35.3 and 35.4, for example likewise by screwing. As an alternative, riveting or spot welding of the spacer bolts is possible. In each case, one locking washer 36.1, 36.2, 36.3 and 36.4 is used on the base plate 34 as a releasable fastening device. The concealed spacer bolts and fastening device have been labeled by designations between parentheses. The adjusting and fastening bolt 392 and the adjusting and fastening piece 391 form an adjusting and fastening device 39.

Figure 4:
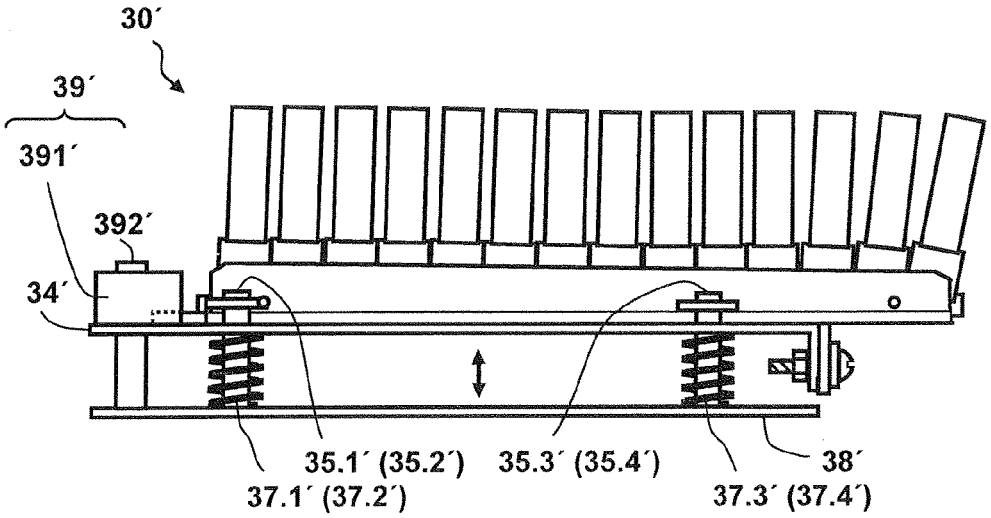
FIG. 4 is a front-elevational view of the pressing apparatus having a sprung slide-in unit.

FIG. 4 shows a front view of a holding carrier 30 having a multiplicity of brush elements and a sprung slide-in unit, with the brush elements likewise being disposed in the form of a brush, as has already been explained by using FIG. 3. The construction of the slide-in unit is also comparable to that shown in FIG. 3, but with the addition of spiral springs 37.1', 37.2', 37.3° and 37.4° which are each plugged onto a respective one of bolts 35.1', 35.2', 35.3° and 35.4°. A base plate 34' in each case has one opening for one of the bolts 35.1', 35.2', 35.3° and 35.4°, as a result of which the bolts can slide through at one end, with a force having to be applied counter to the spring action. The spacer bolts 35.1', 35.2', 35.3° and 35.4° are fastened at their other end on the floor plate 38', for example likewise by screwing, riveting or spot welding. An adjusting bolt 392' and an adjusting piece 391' form an adjusting device 39'.

The adjusting and fastening device 39 and the adjusting device 39' can also be configured differently as an alternative. Other spring elements 37 can also be used for suspending the pressing apparatus 30 in the case of thicker items of mail, while continuing to proceed from the basic concept that the pressing elements have a spring action per se.

In the exemplary embodiments which were explained in the preceding text, the invention was explained by using brush elements. However, other pressing elements are not to be ruled out thereby, in order to realize the invention. Synthetically produced pressing elements in strip, lamellar, pin or comb form may likewise be suitable. A greater number of individual resilient or sprung constituent parts or components of the pressing elements reduce an offset in the transport direction and therefore the occurrence of joining errors. For this reason, brush elements are discussed or the invention is explained by using them in a representative manner for other embodiments.

The number of individual bristles or hairs of the brush elements is higher, at least transversely with respect to the transport direction, than in the case of the individual strips of a strip or lamellar form.

Brush elements which run in and out have a special geometry. The brush elements can be disposed on the holding carrier in such a way that they are inclined or at right angles with respect to the transport belt. As an alternative, the individual brush elements can also be replaced by a complete brush body.

Fourteen brush elements have been shown in the above-mentioned examples, but that is not to rule out the fact that more or fewer brush elements could be used. In the extreme case, a brush element having an excess size or a brush which cannot be divided into brush elements is used. The number of bristles or brush hairs per brush element lies in the two figure to four figure range. Instead of animal hair, a piece of fur with a pronounced preferential fur stroke direction can be used, with the stroke direction having to point in the transport direction. However, only synthetically produced fur products or brush elements are preferably used. A lower number can be sufficient in the case of synthetic bristles with a special geometry, but their number is still much higher even in this case than is customary in usual pressing elements nowadays.

There is provision for the brush elements to act with a first spring constant F1 on the item of mail and for the spring elements of the slide-in unit to act with a second spring constant F2 on the item of mail, where in this case, the following is true: F1<<F2.

The brush elements include a multiplicity of synthetic or animal hairs or bristles. Special spring characteristics can be produced for the brush elements B1 to Bn which are different than those of the spring elements 37, in particular due to their profile and the gradient of the thickness of the synthetic hairs which decreases toward the tip.

A mail item transport apparatus is equipped with a transport belt which is known per se, preferably a driven wide tensioned flat belt. The latter is guided past closely under or on parts of the printing module over deflection rollers of a roller carrier.

The roller carrier 20 of the transport apparatus is disposed in a horizontal and stationary manner in the machine with respect to the pressing apparatus 30 in the z-direction, with the pressing apparatus 30 pressing the item of mail which is fed in onto the transport belt. The transport belt is a flat belt which acts on a part of the surface of the items of mail with a predefined adhesion friction in the transport region. That part of the surface is not printed but is close to the printing region.

In contrast with this, the adhesion friction of the pressing apparatus 30 is minimized at least in a preferential direction, with the latter coinciding with the transport direction.

The invention is not restricted to the present embodiment per se. Rather, a number of units are conceivable within the scope of the claims. The units are used and are included by the present claims in a manner which proceeds from the same basic concept of the invention.

The invention claimed is:

1. In a microprocessor-controlled printing apparatus including a transport module having a transport belt onto which the flat materials are pressed in a supporting region counter to the force of gravity, a printing module not moving during printing in a printing position, and a feed table on which flat materials are fed in to the printing apparatus, an apparatus for pressing the flat materials onto the transport module, said apparatus comprising:

a holding carrier disposed under the feed table; and pressing elements for protruding through an opening formed in the feed table to provide pressure from below on the transport belt of the transport module;

said holding carrier including a plurality of holders rigidly fixed to said holding carrier, said pressing elements being mounted on said holding carrier by said plurality of holders, wherein a multiplicity of individual resilient components or a multiplicity of said pressing elements are disposed on said holding carrier below the transport belt in a transport direction.

2. The apparatus according to claim 1, which further comprises a slide-in unit, said holding carrier being fastened on said slide-in unit, and said pressing elements being spring elements having an inherent spring action.

3. The apparatus according to claim 1, wherein said holding carrier is resiliently mounted to a floor plate.

4. The apparatus according to claim 3, which further comprises a sprung slide-in unit on which said holding carrier is fastened.

5. The apparatus according to claim 1, wherein said pressing elements have a geometry permitting said pressing elements to run in and out.

6. The apparatus according to claim 5, wherein said pressing elements running in and out are brush elements having a multiplicity of bristles or hairs with said geometry.

7. The apparatus according to claim 1, wherein said pressing elements said pressing elements are disposed on said holding carrier at an incline or at right angles relative to the transport belt.

8. The apparatus according to claim 1, wherein said individual pressing elements are part of a complete pressing body having a multiplicity of individual resilient components of said pressing elements.

9. The apparatus according to claim 1, which further comprises a multiplicity of synthetically produced bristles or hairs disposed in a brush element or in a complete brush body with a preferential direction, said holding carrier being mounted or adjusted to cause said preferential direction to coincide with said transport direction.

10. The apparatus according to claim 1, wherein said pressing elements are produced synthetically in a strip, lamellar, pin, comb or brush shape.

11. The apparatus according to claim 1, wherein the multiplicity of said pressing elements are resilient.

* * * * *